US011186920B1

(12) United States Patent
Chen et al.

(10) Patent No.: US 11,186,920 B1
(45) Date of Patent: Nov. 30, 2021

(54) APPARATUS CAPABLE OF LOCAL POLISHING AND PLASMA-ELECTROLYTIC POLISHING SYSTEM

(71) Applicant: Metal Industries Research & Development Centre, Kaohsiung (TW)

(72) Inventors: Yu Kai Chen, Taichung (TW); Chun Wei Chen, Taichung (TW); Zhi-Wen Fan, Miaoli County (TW); You Lun Chen, Taichung (TW); Wen-Chieh Wu, Taichung (TW)

(73) Assignee: Metal Industries Research & Development Centre, Kaohsiung (TW)

( * ) Notice: Subject to any disclaimer, the term of this patent is extended or adjusted under 35 U.S.C. 154(b) by 0 days.

(21) Appl. No.: 17/009,771

(22) Filed: Sep. 1, 2020

(51) Int. Cl.
*C25F 3/16* (2006.01)
*C25F 7/00* (2006.01)

(52) U.S. Cl.
CPC . *C25F 3/16* (2013.01); *C25F 7/00* (2013.01)

(58) Field of Classification Search
CPC ..... C25F 7/00; C25F 3/16–28
See application file for complete search history.

(56) References Cited

U.S. PATENT DOCUMENTS 6,264,817 B1 7/2001 Timoshenko et al.
2020/0070249 A1* 3/2020 Ozdoganlar ..... B08B 1/00

FOREIGN PATENT DOCUMENTS

| | | | | |
|---|---|---|---|---|
| CN | 102828186 | | 12/2012 | |
| CN | 110125734 A | * | 8/2019 | ..... B24B 1/00 |
| TW | 538146 | | 6/2003 | |
| TW | I418664 | | 12/2013 | |
| TW | I591215 | | 7/2017 | |
| TW | M602564 | * | 10/2020 | ..... C25F 3/16 |

* cited by examiner

*Primary Examiner* — Nicholas A Smith
(74) *Attorney, Agent, or Firm* — JCIPRNET

(57) ABSTRACT

An apparatus capable of local polishing and suitable for performing a plasma-electrolytic polishing process on an object is provided. The apparatus capable of local polishing includes a fixing seat, a motion mechanism, and a jet module connected to the motion mechanism and including an electrolyte communication port, a gas communication port, a power connection area, and a jet flow outlet. The jet flow outlet faces the fixing seat and is communicated with the electrolyte communication port and the gas communication port to be suitable for performing the plasma-electrolytic polishing process on the object fixed on the fixing seat. A plasma-electrolytic polishing system including an apparatus capable of local polishing is also provided.

17 Claims, 8 Drawing Sheets

APPARATUS CAPABLE OF LOCAL POLISHING AND PLASMA-ELECTROLYTIC POLISHING SYSTEM

BACKGROUND

Technical Field

The disclosure relates to a polishing apparatus and a system, and more particularly, to an apparatus capable of local polishing and a plasma-electrolytic polishing system including the apparatus capable of local polishing.

Description of Related Art

Plasma-electrolytic polishing is a green process, may be utilized to perform polishing on a workpiece in a complicated shape, and may reduce pollution possibly caused by chemical polishing and electrolytic polishing.

However, traditional plasma-electrolytic polishing needs to soak a polished workpiece in an electrolytic cell, and this may cause certain limitation on an application range of the plasma-electrolytic polishing.

SUMMARY

The disclosure provides an apparatus capable of local polishing and a plasma-electrolytic polishing system including the apparatus capable of local polishing, which is suitable for performing a plasma-electrolytic polishing process on an object.

The apparatus capable of local polishing of the disclosure is suitable for performing a plasma-electrolytic polishing process on an object. The apparatus capable of local polishing includes a fixing seat, a motion mechanism, and a jet module. The jet module is connected to the motion mechanism. The jet module includes an electrolyte communication port, a gas communication port, a power connection area, and a jet flow outlet. The jet flow outlet faces the fixing seat. The jet flow outlet is communicated with the electrolyte communication port and the gas communication port, so as to be suitable for performing the plasma-electrolytic polishing process on the object fixed on the fixing seat.

In an embodiment of the disclosure, the jet module includes a post, a jet nozzle and, a sleeve member. The post is provided with the power connection area, the electrolyte communication port and an electrolyte flowing passage communicated with the electrolyte communication port. The jet nozzle is provided with a connection area block and a jet-out area block opposite to the connection area block. The connection area block is connected to the post. Additionally, the jet-out area block is provided with a jet port. The sleeve member sleeves the post. The sleeve member is provided with the gas communication port and a gas outlet communicated with the gas communication port. A part of the jet nozzle is located in the gas outlet. A gap is provided between the jet nozzle and an inner wall of the gas outlet. The gas outlet and the jet port form a jet flow outlet.

In an embodiment of the disclosure, a part of the jet-out area block is located in the gas outlet. A position of the jet-out area block with a maximum cross section width is located at a tail end of the jet-out area block. Additionally, the tail end of the jet-out area block is not located in the gas outlet.

In an embodiment of the disclosure, the cross section width of the jet-out area block is gradually increased towards the tail end of the jet-out area block.

In an embodiment of the disclosure, the jet nozzle is provided with a flowing passage. A tail end of the flowing passage is the jet port. Additionally, a position of the flowing passage with a minimum cross section width is located at the tail end of the flowing passage.

In an embodiment of the disclosure, the gas outlet has a calibre. The calibre is gradually increased towards a tail end of the gas outlet.

In an embodiment of the disclosure, the jet module further includes a connecting member. The connecting member connects the post and the sleeve member. Additionally, the connecting member is an insulator.

In an embodiment of the disclosure, a surface of the fixing seat facing the jet module is provided with at least one flow guide passage.

The plasma-electrolytic polishing system of the disclosure includes the apparatus capable of local polishing of the above embodiments and a control system. The control system is at least in signal connection to the motion mechanism of the apparatus capable of local polishing.

In an embodiment of the disclosure, the apparatus capable of local polishing further includes an electrolyte control member. The electrolyte supply source is suitable for being connected to the electrolyte communication port through the electrolyte control member. Additionally, the control system is further in signal connection to the electrolyte control member.

In an embodiment of the disclosure, the apparatus capable of local polishing further includes a gas control member. The gas supply source is suitable for being connected to the gas communication port through the gas control member. Additionally, the control system is further in signal connection to the gas control member.

In an embodiment of the disclosure, the apparatus capable of local polishing further includes a power control member. The power source is suitable for being connected to the power connection area through the power control member. Additionally, the control system is further in signal connection to the power control member.

Based on the above, the apparatus capable of local polishing and the plasma-electrolytic polishing system including the apparatus capable of local polishing may perform local polishing on a specific position or an area of an object in an electrolyte jet mode. Additionally, by using the electrolyte jet mode, limitation on a dimension of an object may be reduced, and a space of a polishing area may also be saved. Further, during polishing through electrolyte jet, an electrolyte jetted from the jet port may flow out together with gas jetted out from the gas outlet. That is, the gas jetted out from the gas outlet approximately may form an annular gas wall, and an electrolyte jet flow basically may be limited in the annular gas wall. Therefore, the polishing accuracy may be improved, and excessive polishing may also be prevented.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1A:
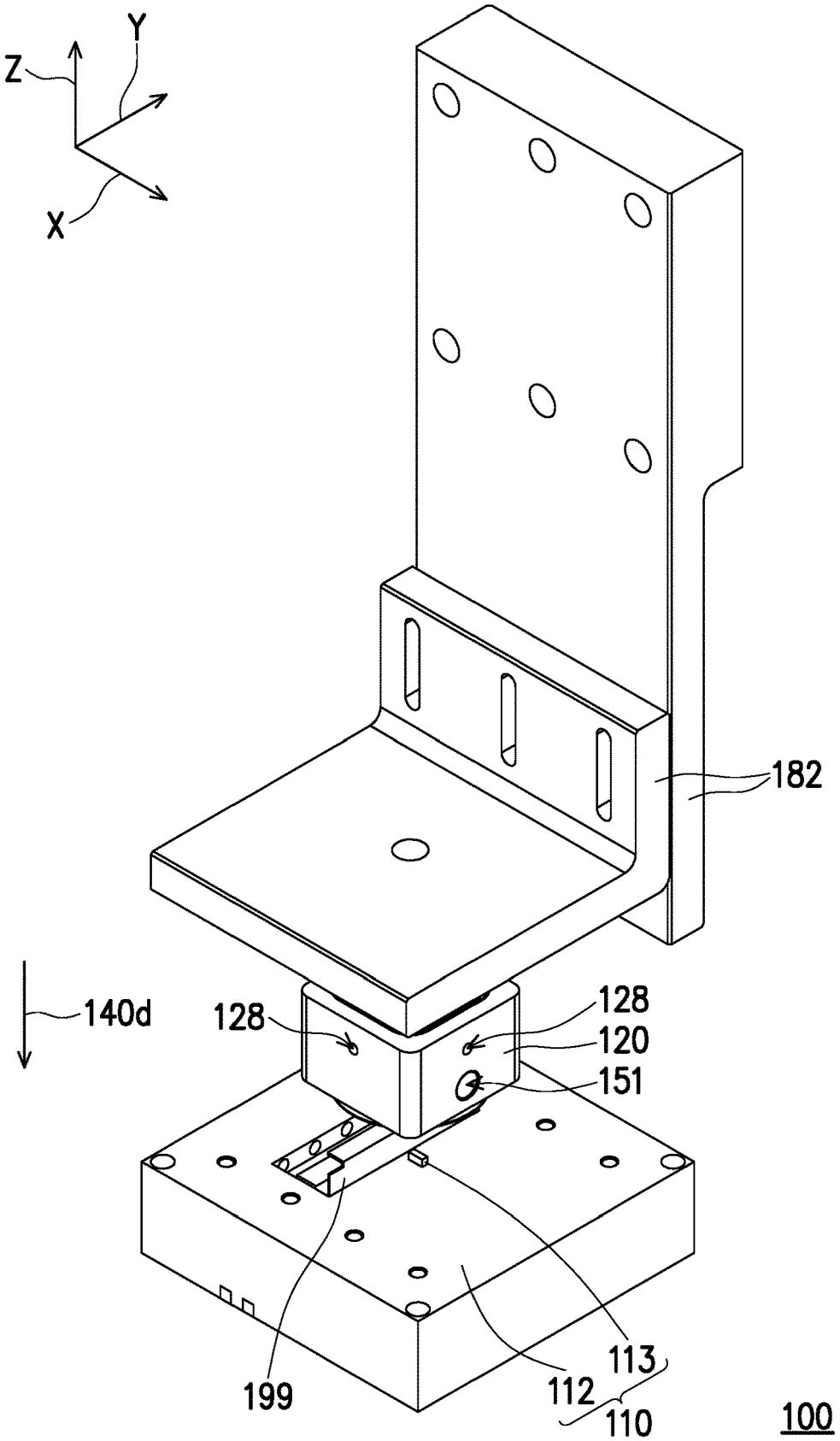
FIG. 1A is a stereoscopic schematic view of partial assembly of an apparatus capable of local polishing according to a first embodiment of the disclosure.

The disclosure is elaborated more comprehensively with reference to the figures of the embodiments. However, the disclosure may also be reflected in various different forms rather than being limited to the embodiments in this specification. The Thickness of films and regions in the drawings are enlarged for clarity. The same or similar reference numbers represent the same or similar elements, and details are not repeated in the following paragraphs. In addition, the directional terms mentioned in the embodiments, such as "above", "below", "left", "right", "front", and "rear", refer to the directions in the accompanying drawings. Therefore, unless otherwise specified, the directional terms used are merely used for describing rather than limiting the disclosure. In addition, to display the directional relationships between different drawings clearly, the Cartesian coordinate system (that is, an XYZ rectangular coordinate system) is used in partial drawings to display a corresponding direction. Besides, for clear representation, some structures may be omitted in the drawings.

The term set used herein is merely used for describing the objectives of special implementations rather than limiting the idea of the disclosure. As used herein, the singular form "one" is intended to include a plural form, unless this specification clearly indicates otherwise. It should be further understood that, the term "include", when used in this specification, describes the presence of features, unities, steps, operations, elements, and/or components, but does not exclude the presence or addition or one or more features, unities, steps, operations, elements, components, and/or groups.

Unless otherwise defined, all terms (including technical terms and scientific terms) used herein are provided with the same meanings that are generally understood by a person of ordinary skill in the art. It should be further understood that, the terms (such as those defined in a dictionary generally used) should be explained as meanings consistent with the meanings in the related technology background, and should not be explained as meanings that are idealized or excessively formal, unless the terms are clearly defined herein.

Figure 1B:
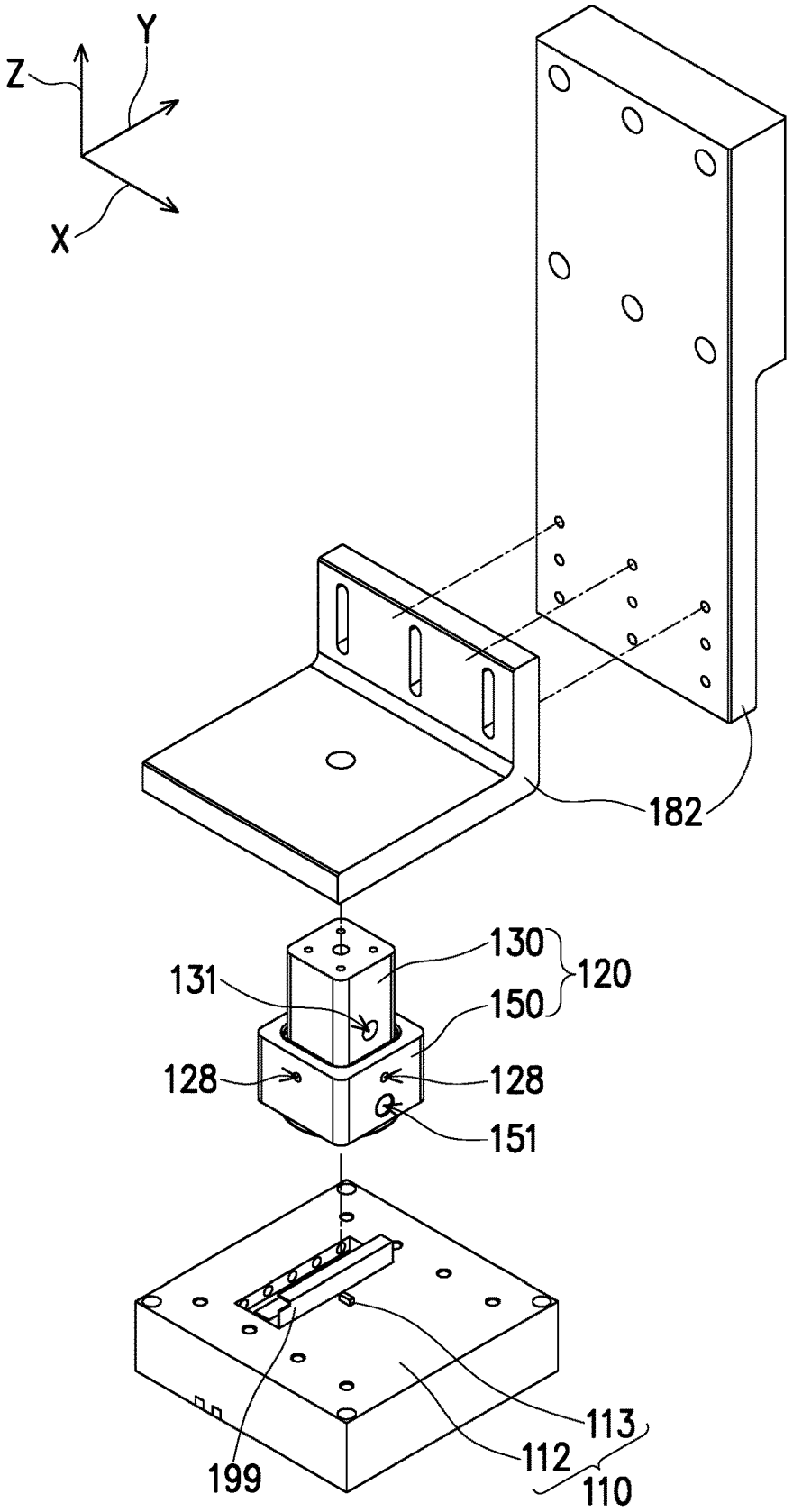
FIG. 1B is a partial exploded stereoscopic schematic view of the apparatus capable of local polishing according to the first embodiment of the disclosure.
Figure 1C:
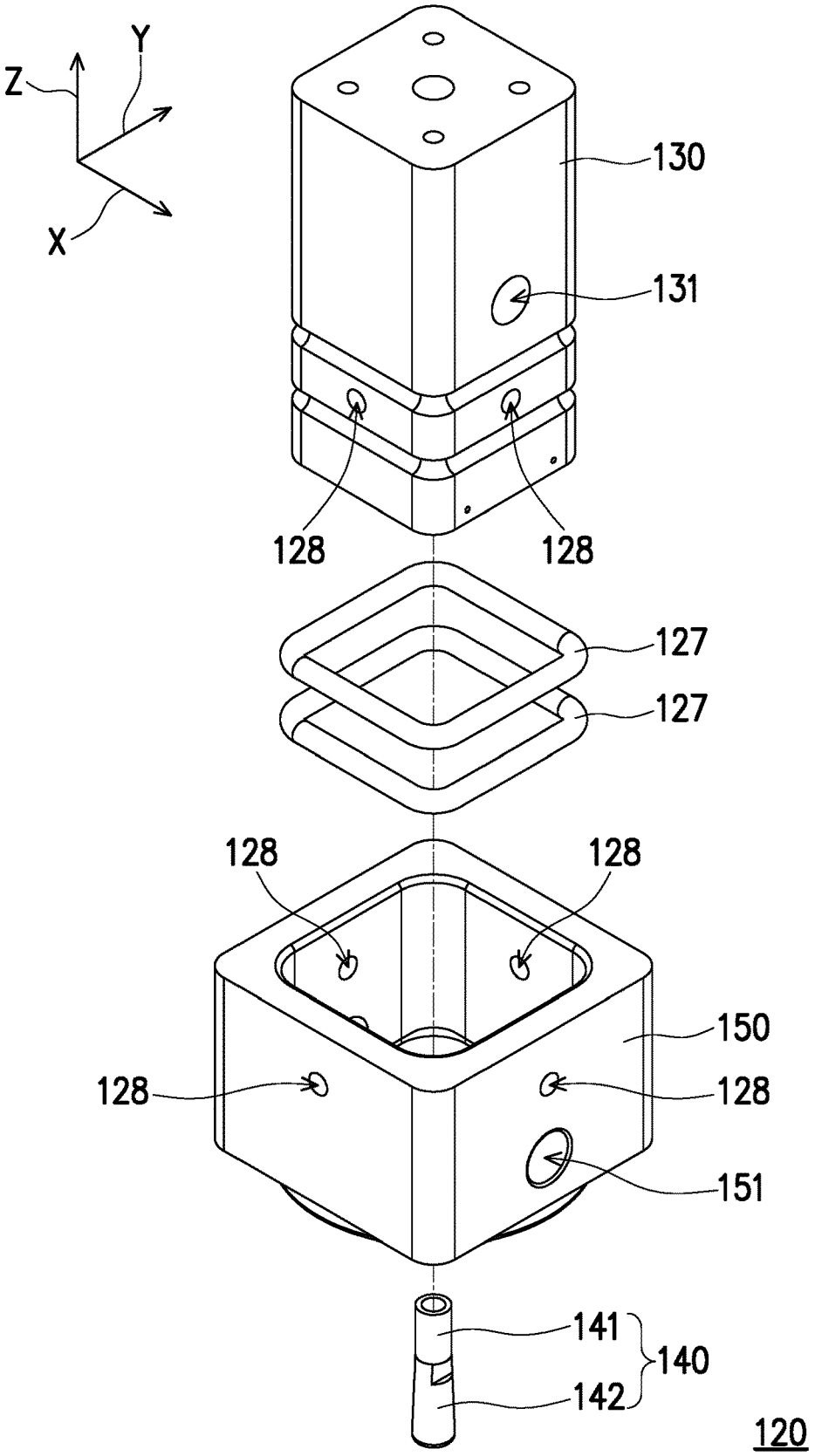
FIG. 1C is a partial exploded stereoscopic schematic view of the apparatus capable of local polishing according to the first embodiment of the disclosure.
Figure 1D:
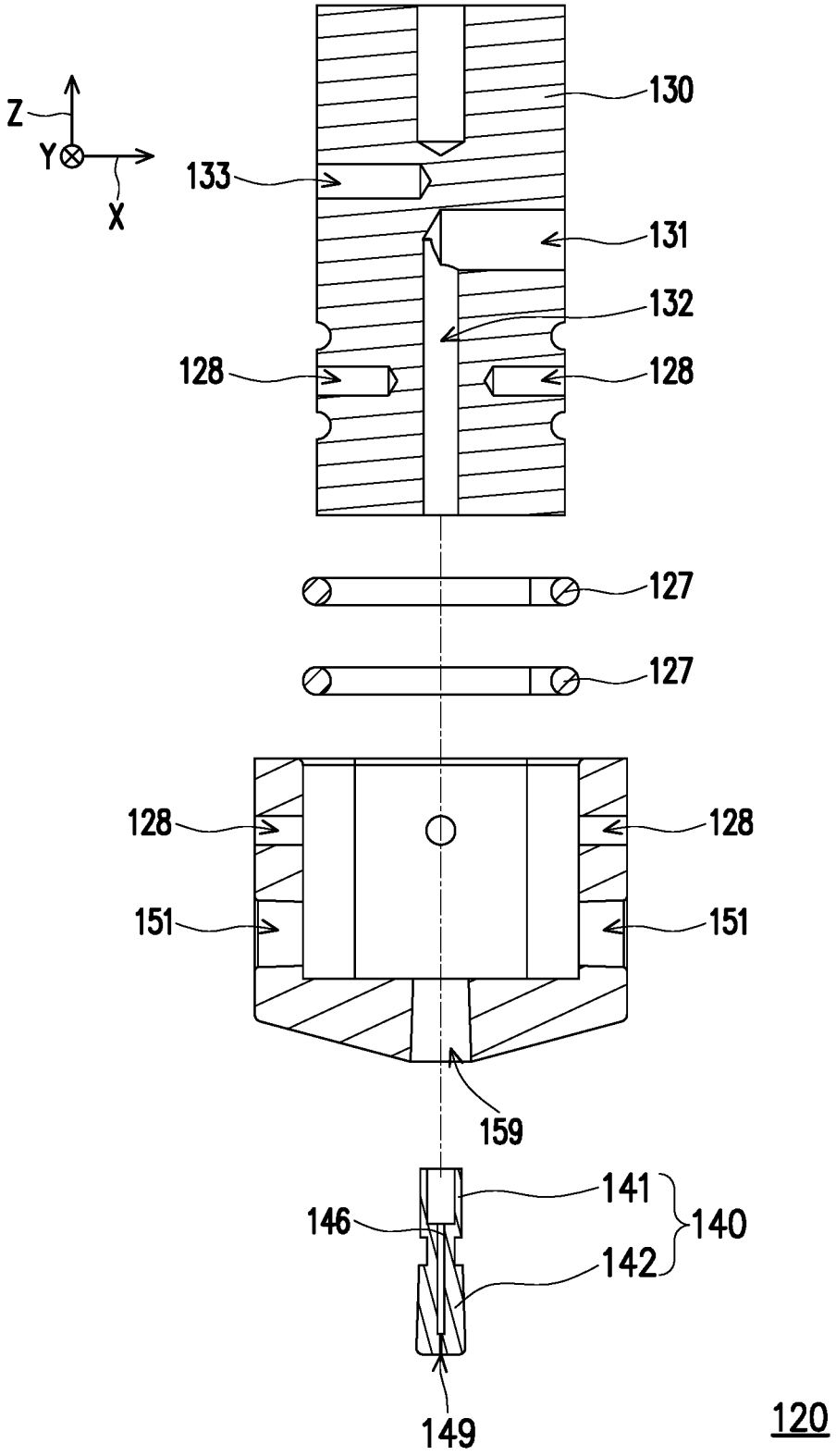
FIG. 1D is a partial exploded cross-sectional schematic view of the apparatus capable of local polishing according to the first embodiment of the disclosure.
Figure 1E:
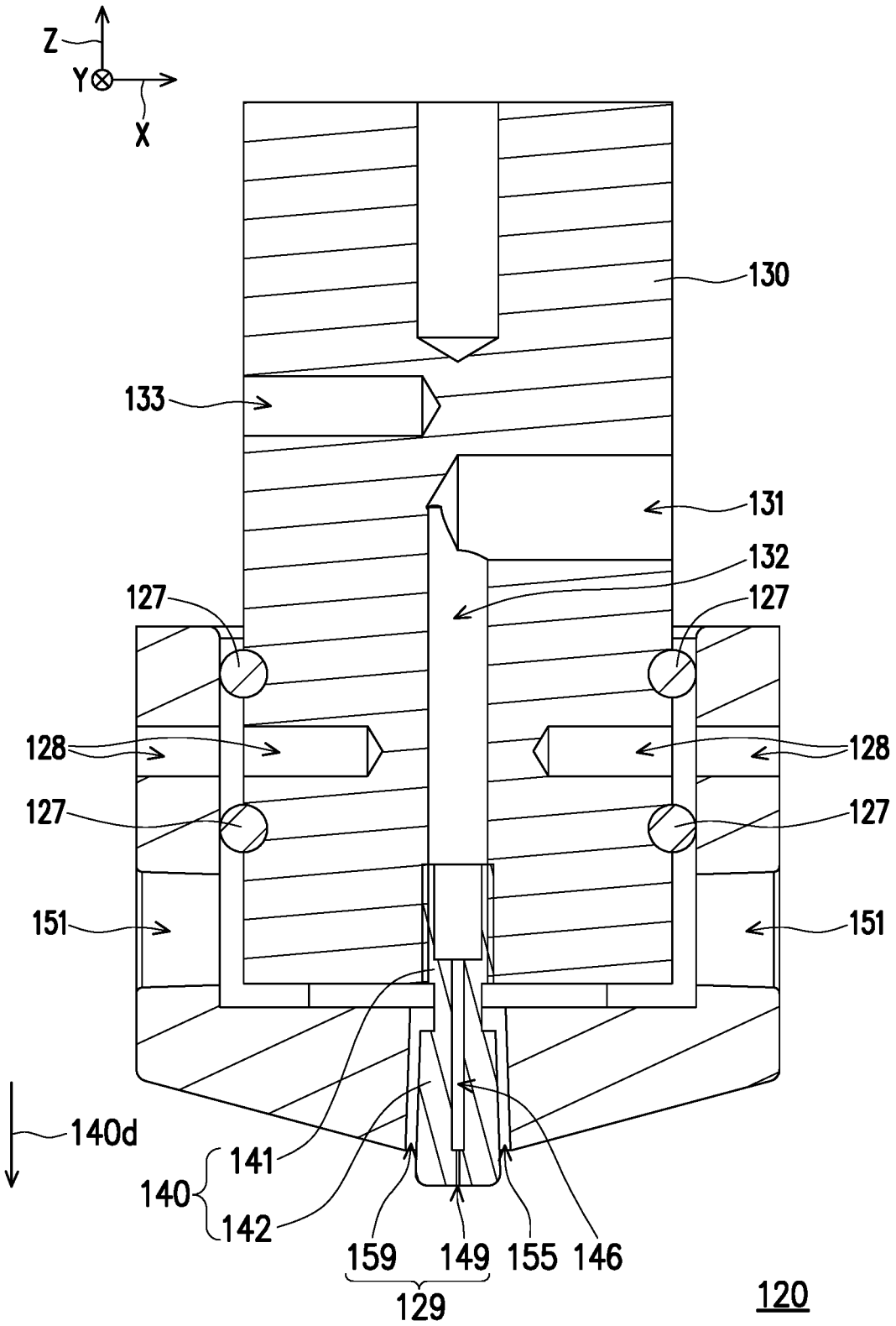
FIG. 1E is a cross-sectional schematic view of partial assembly of the apparatus capable of local polishing according to the first embodiment of the disclosure.
Figure 1F:
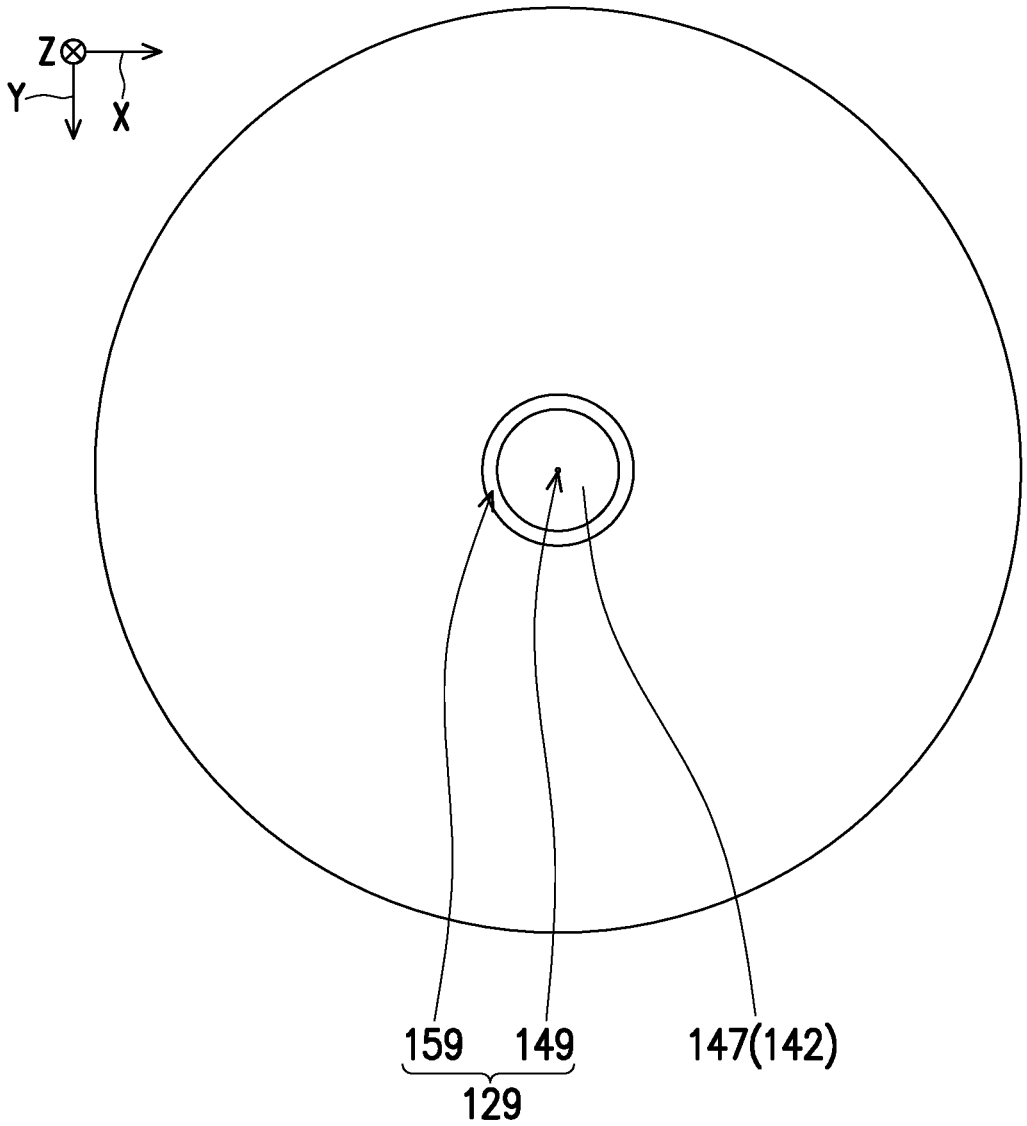
FIG. 1F is a bottom schematic view of partial assembly of the apparatus capable of local polishing according to the first embodiment of the disclosure.

FIG. 1A is a stereoscopic schematic view of partial assembly of an apparatus capable of local polishing according to a first embodiment of the disclosure. FIG. 1B is a partial exploded stereoscopic schematic view of the apparatus capable of local polishing according to the first embodiment of the disclosure. FIG. 1C is a partial exploded stereoscopic schematic view of the apparatus capable of local polishing according to the first embodiment of the disclosure. FIG. 1D is a partial exploded cross-sectional schematic view of the apparatus capable of local polishing according to the first embodiment of the disclosure. FIG. 1E is a cross-sectional schematic view of partial assembly of the apparatus capable of local polishing according to the first embodiment of the disclosure. FIG. 1F is a bottom schematic view of partial assembly the apparatus capable of local polishing according to the first embodiment of the disclosure. For example, FIG. 1C may be a partial exploded stereoscopic schematic view corresponding to a jet module of the apparatus capable of local polishing. FIG. 1D may be a partial exploded cross-sectional schematic view corresponding to the jet module of the apparatus capable of local polishing. FIG. 1E may be a partial assembly cross-sectional schematic view corresponding to the jet module of the apparatus capable of local polishing. FIG. 1F may be a bottom schematic view of partial assembly corresponding to the jet module of the apparatus capable of local polishing.

Referring to FIG. 1A to FIG. 1F, an apparatus capable of local polishing 100 is suitable for performing a plasma-electrolytic polishing process on an object 199.

Referring to FIG. 1A first, the apparatus capable of local polishing 100 includes a fixing seat 110, a jet module 120, and a motion mechanism 182. The jet module 120 is connected to the motion mechanism 182. In an embodiment, the fixing seat 110 is suitable for fixing the object 199.

Figure 1G:
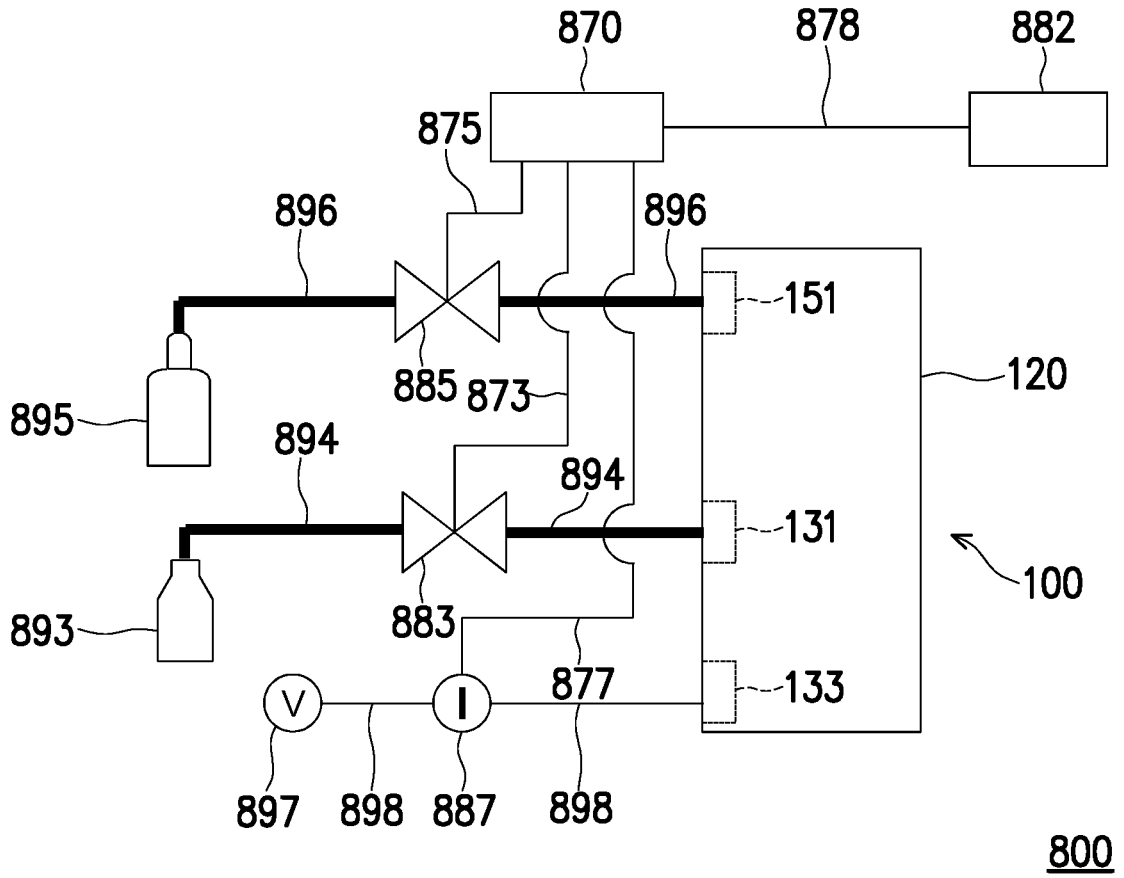
FIG. 1G is a schematic view of partial connected lines of a plasma-electrolytic polishing system according to the first embodiment of the disclosure.

Referring to FIG. 1B and FIG. 1E next, the jet module 120 includes an electrolyte communication port 131, a gas communication port 151, a power connection area 133, and a jet flow outlet 129. The jet flow outlet 129 faces the fixing seat 110. Additionally, the jet flow outlet 129 is communicated with the electrolyte communication port 131 and the gas communication port 151, so that the jet module 120 is suitable for performing the plasma-electrolytic polishing process on the object 199 fixed on the fixing seat 110 through the jet flow outlet 129. In an embodiment, the electrolyte communication port 131 is suitable for being connected to an electrolyte supply source (e.g., an electrolyte supply source 893 as shown in FIG. 1G, but the disclosure is not limited thereto). In an embodiment, the gas communication port 151 is suitable for being connected to a gas supply source (e.g., a gas supply source 895 as shown in FIG. 1G, but the disclosure is not limited thereto).

In an embodiment, the fixing seat 110 may include a base 112 and at least one fixing member 113. The fixing member 113 is, for example, a common screw, screw bolt, gasket, screw cap, clamping member, and the like, and the disclosure is not limited thereto. Corresponding holes (such as screw holes), grooves (such as clamp grooves) and the like may be provided in the fixing seat 110, so as to be suitable for fixing the object 199 onto the base through the fixing member.

In an embodiment, a main body material (such as a material of the base) of the fixing seat 110 may be an insulator. Therefore, when a plasma-electrolytic polishing process is performed on the object 199, a current flowing through the fixing seat 110 may be reduced.

In an embodiment, the jet module 120 may be connected to the motion mechanism 182 through the common fixing member. Therefore, by controlling the motion mechanism 182, the jet module 120 may be regulated, so that the jet flow outlet 129 of the jet module 120 faces a predetermined orientation, and the jet module 120 may be suitable for performing the plasma-electrolytic polishing process on the object 199 fixed on the fixing seat 110 through the jet flow outlet 129.

In an embodiment, the motion mechanism 182 may include a movable module (such as a horizontal motion module, a vertical motion module, a rotary motion module or a combination thereof) commonly used on the design of a movable mechanism. The motion mechanism 182 may include corresponding hardware or software, or is further combined with an auxiliary member. For example, the movable module may be formed by a power supply apparatus, a motor, a belt, a gear, other relevant elements, and the like, and the disclosure is not limited thereto. The relevant elements, for example, may include a communication element, a power element, a display element and the like, and the disclosure is not limited thereto. The software, for example, includes space position operation software, error recording software, communication software and the like, and the disclosure is not limited thereto. The auxiliary member, for example, includes a moving rail, a moving shaft, a shock absorption element, a positioning apparatus, and the like, and the disclosure is not limited thereto.

In an embodiment, the motion mechanism 182 is, for example, a mechanical arm, but the disclosure is not limited thereto.

In the present embodiment, the jet module 120 may include a post 130, a jet nozzle 140 and a sleeve member 150. A material of the post 130 includes a conductor. Additionally, the post 130 is provided with the power connection area 133, the electrolyte communication port 131 and an electrolyte flowing passage 132. The electrolyte flowing passage 132 is communicated with the electrolyte communication port 131. The jet nozzle 140 is provided with a connection area block 141 and a jet-out area block 142. The jet-out area block 142 is opposite to the connection area block 141. The connection area block 141 may be connected to the post 130. The jet-out area block 142 is provided with a jet port 149. The sleeve member 150 may sleeve the post 130. The sleeve member 150 is provided with the gas communication port 151 and a gas outlet 159. The gas outlet 159 is communicated with the gas communication port 151. A part of the jet nozzle 140 is located in the gas outlet 159. In a state that the connection area block 141 is connected to the post 130, and the sleeve member 150 sleeves the post 130 (such as a state drawn in FIG. 1E), a gap 155 may be formed between the jet nozzle 140 and an inner wall of the gas outlet 159, and the gas outlet 159 and the jet port 149 form the jet flow outlet 129 of the jet module 120.

In an embodiment, the sleeve member 150 and the post 130 may be connected in a mutually sleeving way through a connecting member 127 (such as an O-ring, other similar elastic rings or an annular gasket). In an embodiment, corresponding fixing holes 128 (such as screw holes) may be formed between the sleeve member 150 and the post 130, so that the sleeve member 150 and the post 130 may be connected in a mutually sleeving way through a corresponding connecting member (such as a screw or a corresponding gasket).

In an embodiment, the connecting member 127 is an insulator. Therefore, the sleeve member 150 and the post 130 may be insulated from each other, or a current flowing through the sleeve member 150 may be reduced.

In an embodiment, the connecting member for connecting the sleeve member 150 and the post 130 may be insulated. For example, the connecting member for connecting the sleeve member 150 and the post 130 may be an insulation screw or a corresponding insulation gasket.

In an embodiment, an example of performing the plasma-electrolytic polishing process on the object 199 fixed on the fixing seat 110 by the apparatus capable of local polishing 100 is as follows. However, it is worth noting that the following plasma-electrolytic polishing process is only an illustrative example, and the disclosure does not limit practical steps of performing the plasma-electrolytic polishing process by the apparatus capable of local polishing 100.

In an embodiment, the object 199 may be firstly fixed on the base through the fixing member. The object 199 may be electrically connected to a grounding end through an electric wire (not drawn). In an embodiment, a grounding electric wire electrically connected to the object 199 may be directly connected to the object 199, but the disclosure is not limited thereto. In an embodiment, the grounding electric wire electrically connected to the object 199 may be indirectly connected to the object 199 through a conductive fixing member (such as the fixing member 113 or other possible conductive fixing members) for fixing the object 199.

FIG. 1G is a schematic view of partial connected lines of a plasma-electrolytic polishing system according to the first embodiment of the disclosure.

Referring to FIG. 1G, the apparatus capable of local polishing 100 and a control system 870 may form a plasma-electrolytic polishing system 800. That is, the plasma-electrolytic polishing system 800 may include the apparatus capable of local polishing 100 and the control system 870. In other unshown embodiments, an apparatus capable of local polishing similar to the apparatus capable of local polishing 100 may also form a plasma-electrolytic polishing system similar to the plasma-electrolytic polishing system 800 together with the control system 870.

In the present embodiment, the control system 870 may be in signal connection to the motion mechanism 182 through a signal wire 878 in a wired signal transmission mode, but the disclosure is not limited thereto. In an embodiment, the control system 870 may be in signal connection to the motion mechanism 182 in a wireless signal transmission mode. In other words, the signal connection mentioned in the disclosure may generally refer to a connection mode of wired signal transmission or wireless signal transmission. Additionally, the disclosure does not limit that all signal connection modes need to be identical or different.

In the present embodiment, the plasma-electrolytic polishing system 800 may further include an electrolyte control member 883. The electrolyte supply source 893 is suitable for being connected to the electrolyte communication port 131 through the electrolyte control member 883. Additionally, the control system 870 may be further in signal connection to the electrolyte control member 883.

For example, the electrolyte supply source 893 may be connected to the electrolyte communication port 131 through a corresponding fluid pipeline 894. One end of the fluid pipeline 894 may be communicated with the electrolyte supply source 893 (such as an electrolyte-containing bottle and a corresponding pump). The other end of the fluid pipeline 894 may be communicated with the electrolyte communication port 131. The electrolyte control member 883 may be provided on the fluid pipeline 894. The electrolyte control member 883 is, for example, a liquid electromagnetic valve, but the disclosure is not limited thereto. For another example, the electrolyte control member 883 in signal connection to the control system 870 may set, control or detect the quantity, time or flow rate of a flowing electrolyte. Additionally, the electrolyte supply source 893 and a flowing path, type and quantity of the corresponding fluid pipeline may be regulated according to actual requirements, and the disclosure is not limited thereto. The control system 870 may be in signal connection to the electrolyte control member 883 through a signal wire 873 in a wired signal transmission mode, but the disclosure is not limited thereto.

In the present embodiment, the plasma-electrolytic polishing system 800 may further include a gas control member 885. The gas supply source 895 is suitable for being connected to the gas communication port 151 through the gas control member 885. Additionally, the control system 870 may be further in signal connection to the gas control member 885.

For example, the gas supply source 895 may be connected to the gas communication port 151 through a corresponding gas pipeline 896. One end of the gas pipeline 896 may be communicated with the gas supply source 895 (such as a gas-containing steel cylinder and a corresponding pump). The other end of the gas pipeline 896 may be communicated with the gas communication port 151. The gas control member 885 may be provided on the gas pipeline 896. The gas control member 885 may be a gas electromagnetic valve, but the disclosure is not limited thereto. For another example, the gas control member 885 in signal connection to the control system 870 may set, control or detect the quantity, time or flow rate of the flowing gas. Additionally, the gas supply source 895 and a flow path, type, quantity of the corresponding gas pipeline may be regulated according to actual requirements, and the disclosure is not limited thereto. The control system 870 may be in signal connection to the electrolyte control member 883 through a signal wire 875 in a wired signal transmission mode, but the disclosure is not limited thereto.

In the present embodiment, the plasma-electrolytic polishing system 800 may further include a power control member 887. A power source 897 is suitable for being connected to the power connection area 133 through the power control member 887. Additionally, the control system 870 may be further in signal connection to the power control member 887.

For example, the power source 897 may be connected to the power connection area 133 through a corresponding circuit 898. One end of the circuit 898 may be electrically connected to the power source 897. The other end of the circuit 898 may be electrically connected to the power connection area 133. The power control member 887 may be provided on the circuit 898. The power control member 887 may be, for example, an electromagnetic switch and/or a corresponding transformer, rectifier, capacitor and the like, but the disclosure is not limited thereto. For another example, the power control member 887 in signal connection to the control system 870 may set, control or detect a current, voltage, frequency or power-on time input into the power connection area 133. The control system 870 may be in signal connection to the power control member 887 through a signal wire 877 in a wired signal transmission mode, but the disclosure is not limited thereto.

In an embodiment, after the object 199 is fixed onto the base 112, the motion mechanism 182 may be regulated through the control system 870, so that the jet flow outlet 129 of the jet module 120 faces an area of the object 199 to be polished. The area of the object 199 to be polished is basically positioned above a surface 111 of the base 112. That is, in the plasma-electrolytic polishing process, at least a part of the object 199 may be covered by the flowing electrolyte, but the object 199 cannot be completely and continuously soaked by the electrolyte.

In an embodiment, the motion mechanism 182 is regulated by the control system 870. A distance between the jet flow outlet 129 and the object 199 may also be regulated.

In an embodiment, the gas control member 885, the electrolyte control member 883 and the power control member 887 may be switched on through the control system 870, so that gas flowing out from the gas supply source 895 flows to the gas communication port 151 through the gas control member 885 and is then jetted out from the gas outlet 159. Additionally, the electrolyte flowing out from the electrolyte supply source 893 flows to the electrolyte communication port 131 through the electrolyte control member 883, and is then jetted out from the jet port 149 in a jet-out direction 140*d*. Additionally, high-voltage electric power provided by the power source 897 is transmitted to the power connection area 133 through the power control member 887, so that a high voltage difference exists between the jet nozzle 140 and the object 199.

In an embodiment, the gas control member 885 may be firstly switched on, then, the electrolyte control member 883 is switched on, and next, the power control member 887 is switched on, but the disclosure is not limited thereto.

In an embodiment, high-voltage electric power provided by the power source 897 basically reaches a voltage of 30 V to 400 V, but the disclosure is not limited thereto.

In an embodiment, the type, temperature or flow rate of the electrolyte may be regulated according to the design requirements (such as a type of the object 199 or a polishing specification). For example, if the object 199 is a steel material or a copper material, the electrolyte may be a 40° C.-90° C. mixed electrolyte of phosphoric acid and/or phosphates (such as sodium phosphate, sodium dihydrogen phosphate or disodium hydrogen phosphate).

In an embodiment, a type or flow rate of the gas may be regulated according to design requirements (such as a type of the corresponding electrolyte). For example, the gas may be nitrogen gas, carbon dioxide, helium gas, neon gas, argon gas, other suitable nonreactive gas or a combination thereof.

By using a design mode of the jet module 120, local polishing may be performed on a specific position or an area of the object 199 in an electrolyte jet mode. Additionally, by using the electrolyte jet mode, the limitation on a dimension of the object 199 may be reduced, and a space of a polishing area may also be saved. Additionally, during polishing through electrolyte jet, the electrolyte jetted from the jet port 149 (may be called as electrolyte jet flow) may flow out together with gas jetted out from the gas outlet 159 (may be called as a gas wall). That is, the gas jetted out from the gas outlet 159 approximately may form an annular gas wall, and the electrolyte jet flow basically may be limited in the annular gas wall. Therefore, the polishing accuracy may be improved, and excessive polishing may also be prevented.

In the present embodiment, a part of the jet-out area block 142 is located in the gas outlet 159. A position of the jet-out area block 142 with a maximum cross section width is basically located at a tail end 147 of the jet-out area block 142 (i.e., a position farthest from the connection area block 141). For example, on a cross section vertical to the jet-out direction 140*d* (such as a cross section parallel to a paper surface of FIG. 1F), the tail end 147 of the jet-out area block 142 has a maximum cross section width. In a state that the connection area block 141 is connected to the post 130, and the sleeve member 150 sleeves the post 130 (such as the state drawn in FIG. 1E), the tail end 147 of the jet-out area block 142 is not located in the gas outlet 159. Therefore, when the plasma-electrolytic polishing process is performed on the object 199, unexpected interference between the electrolyte jet flow and the gas wall may be reduced.

In the present embodiment, the cross section width of the jet-out area block 142 is gradually increased towards the tail end 147 of the jet-out area block 142. That is, on a longitudinal cross section parallel to the jet-out direction 140*d* (such as a cross section parallel to a paper surface of FIG. 1E), a profile of an outer side wall of the jet-out area block 142 may be basically an inclined surface. For example, the jet-out area block 142 may be approximately in a cone shape or a frustum shape. Therefore, when a plasma-electrolytic polishing process is performed on the object 199, the gas wall may outwards diffuse while leaving far away from the jet flow outlet 129, and unexpected interference between the electrolyte jet flow and the gas wall may be reduced.

In an embodiment, on a longitudinal cross section parallel to the jet-out direction 140*d*, the profile of the outer side wall of the jet-out area block 142 may be basically an inclined surface. Additionally, on a cross section surface vertical to the jet-out direction 140*d*, the profile of the outer side wall of the jet-out area block 142 is basically in a round shape. For example, the jet-out area block 142 may be approximately in a cone shape or a frustum shape.

In the present embodiment, the jet nozzle 140 is provided with a flowing passage 146. A tail end of the flowing passage 146 is the jet port 149. A position of the flowing passage 146 with a minimum cross section width is located at the tail end of the flowing passage 146. For example, the tail end of the flowing passage 146 has a minimum calibre on the cross section vertical to the jet-out direction 140*d* (such as a cross section parallel to a paper surface of FIG. 1F). Therefore, when the plasma-electrolytic polishing process is performed on the object 199, turbulence may not be formed in the electrolyte jet flow.

In the present embodiment, a position of the gas outlet 159 with the maximum calibre is located at the tail end of the gas outlet 159. For example, on the cross section vertical to the jet-out direction 140*d*, the tail end of the gas outlet 159 has the maximum calibre.

In the present embodiment, the calibre of the gas outlet 159 is gradually increased towards the tail end of the gas outlet 159. That is, on a longitudinal cross section parallel to the jet-out direction 140*d* (such as a cross section parallel to the paper surface of FIG. 1E), the profile of the inner side wall of the gas outlet 159 may be basically an inclined surface. For example, an appearance of the gas outlet 159 may be approximately in a cone shape or a frustum shape.

In an embodiment, the appearance of the gas outlet 159 may be corresponding to an appearance of the jet-out area block 142. Therefore, when the plasma-electrolytic polishing process is performed on the object 199, turbulence may not be formed in the gas wall. For example, the appearance of the gas outlet 159 may be in a cone shape or a frustum shape similar to that of the jet-out area block 142.

Figure 2:
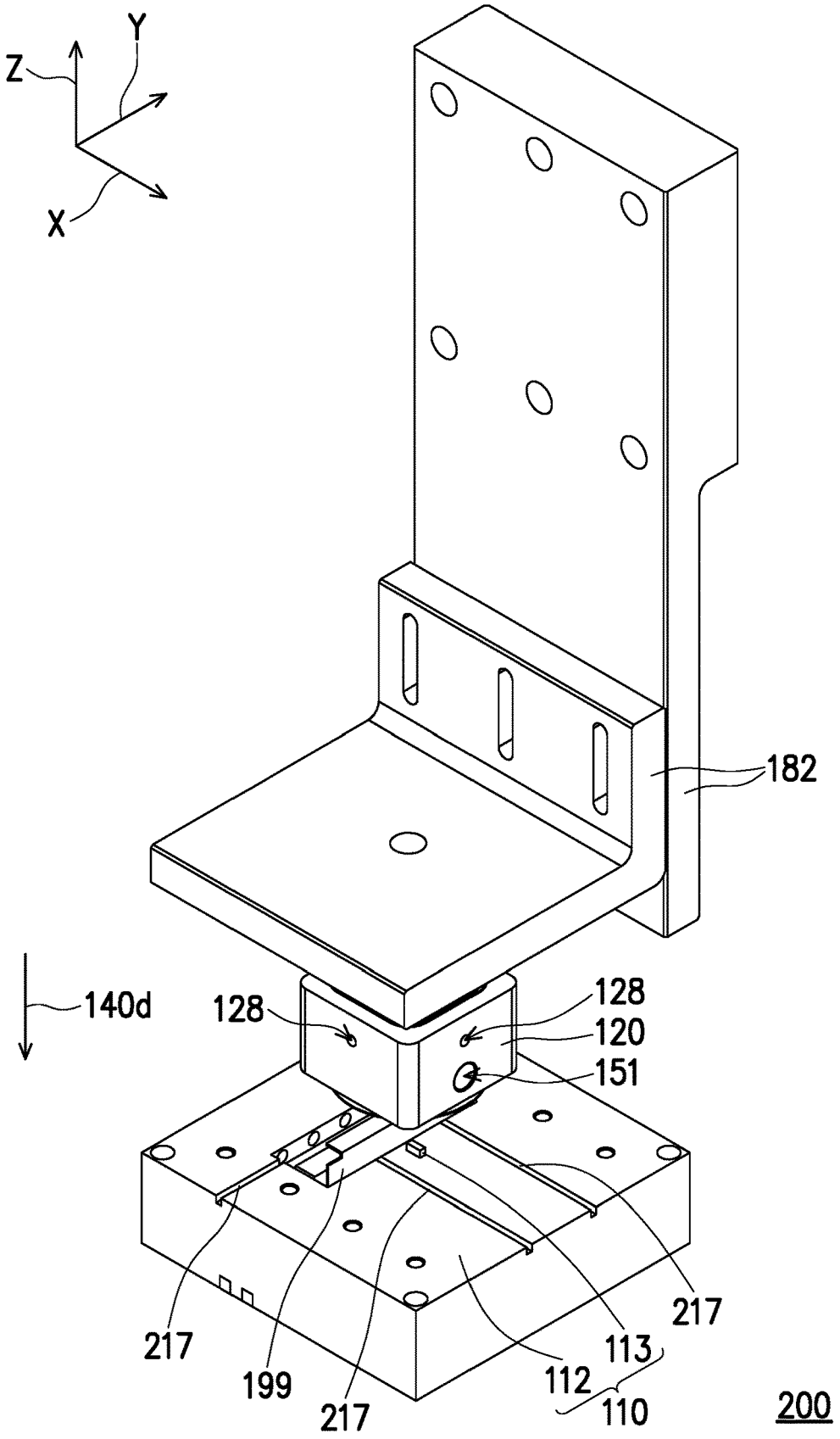
FIG. 2 is a stereoscopic schematic view of partial assembly of an apparatus capable of local polishing according to a second embodiment of the disclosure.

FIG. 2 is a stereoscopic schematic view of partial assembly of an apparatus capable of local polishing according to a second embodiment of the disclosure. An apparatus capable of local polishing 200 according to the present embodiment is similar to the apparatus capable of local polishing 100 of the first embodiment. Similar parts are expressed by the same numerals, and have the similar function, materials or actuating modes, and the descriptions thereof are omitted herein.

In the present embodiment, a surface 111 of a fixing seat 110 of the apparatus capable of local polishing 200 facing a jet module 120 is provided with at least one flow guide passage 217. Therefore, when a plasma-electrolytic polishing process is performed on an object 199, an electrolyte may be more easily guided away from the surface 111 of the fixing seat 110 through the flow guide passage 217.

Based on the above, the apparatus capable of local polishing and the plasma-electrolytic polishing system including the apparatus capable of local polishing of the disclosure may perform local polishing to a specific position or area of the object in an electrolyte jet mode. Additionally, by using the electrolyte jet mode, limitation on a dimension of the object may be reduced, and a space of the polishing area may also be saved. Additionally, during polishing through electrolyte jet, the electrolyte jetted from the jet port may flow out together with the gas jetted out from the gas outlet. That is, the gas jetted out from the gas outlet approximately may form an annular gas wall, and an electrolyte jet flow basically may be limited in the annular gas wall. Therefore, the polishing accuracy may be improved, and excessive polishing may also be prevented.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An apparatus capable of local polishing, suitable for performing a plasma-electrolytic polishing process on an object, the apparatus capable of local polishing comprising:
- a fixing seat;
- a motion mechanism; and
- a jet module, connected to the motion mechanism, wherein the jet module comprises:
  - an electrolyte communication port;
  - a gas communication port;
  - a power connection area; and
  - a jet flow outlet, facing the fixing seat, wherein the jet flow outlet is communicated with the electrolyte communication port and the gas communication port, so as to be suitable for performing the plasma-electrolytic polishing process on the object fixed on the fixing seat.

2. The apparatus capable of local polishing according to claim 1, wherein the jet module comprises:
- a post, comprising the power connection area, the electrolyte communication port, and an electrolyte flowing passage communicated with the electrolyte communication port;
- a jet nozzle, comprising a connection area block and a jet-out area block opposite to the connection area block, wherein the connection area block is connected to the post, and the jet-out area block is provided with a jet port; and
- a sleeve member, sleeving the post, wherein the sleeve member comprises the gas communication port and a gas outlet communicated with the gas communication port, a part of the jet nozzle is located in the gas outlet, a gap is provided between the jet nozzle and an inner wall of the gas outlet, and the gas outlet and the jet port form the jet flow outlet.

3. The apparatus capable of local polishing according to claim 2, wherein a part of the jet-out area block is located in the gas outlet, a position of the jet-out area block with a maximum cross section width is located at a tail end of the jet-out area block, and the tail end of the jet-out area block is not located in the gas outlet.

4. The apparatus capable of local polishing according to claim 3, wherein the cross section width of the jet-out area block is gradually increased towards the tail end of the jet-out area block.

5. The apparatus capable of local polishing according to claim 2, wherein the jet nozzle is provided with a flowing passage, a tail end of the flowing passage is the jet port, and a position of the flowing passage with a minimum cross section width is located at the tail end of the flowing passage.

6. The apparatus capable of local polishing according to claim 2, wherein the gas outlet has a calibre, and the calibre is gradually increased towards a tail end of the gas outlet.

7. The apparatus capable of local polishing according to claim 2, wherein the jet module further comprises:

a connecting member, connected to the post and the sleeve member, wherein the connecting member is an insulator.

8. The apparatus capable of local polishing according to claim 1, wherein a surface of the fixing seat facing the jet module is provided with at least one flow guide passage.

9. A plasma-electrolytic polishing system, suitable for performing a plasma-electrolytic polishing process on an object, comprising:

an apparatus capable of local polishing, comprising:

a fixing seat, suitable for fixing the object;

a motion mechanism; and a jet module, connected to the motion mechanism, wherein the jet module comprises:

an electrolyte communication port, suitable for being connected to an electrolyte supply source;

a gas communication port, suitable for being connected to a gas supply source;

a power connection area, suitable for being connected to a power source; and a jet flow outlet, facing the fixing seat, wherein the jet flow outlet is communicated with the electrolyte communication port and the gas communication port, so as to be suitable for performing the plasma-electrolytic polishing process on the object fixed on the fixing seat; and a control system, at least in signal connection to the motion mechanism of the apparatus capable of local polishing.

10. The plasma-electrolytic polishing system according to claim 9, further comprising:

an electrolyte control member, wherein the electrolyte supply source is suitable for being connected to the electrolyte communication port through the electrolyte control member, and the control system is further in signal connection to the electrolyte control member;

a gas control member, wherein the gas supply source is suitable for being connected to the gas communication port through the gas control member, and the control system is further in signal connection to the gas control member; or a power control member, wherein the power source is suitable for being connected to the power connection area through the power control member, and the control system is further in signal connection to the power control member.

11. The plasma-electrolytic polishing system according to claim 9, wherein the jet module comprises:

a post, comprising the power connection area, the electrolyte communication port, and an electrolyte flowing passage communicated with the electrolyte communication port;

a jet nozzle, comprising a connection area block and a jet-out area block opposite to the connection area block, wherein the connection area block is connected to the post, and the jet-out area block is provided with a jet port; and a sleeve member, sleeving the post, wherein the sleeve member comprises the gas communication port and a gas outlet communicated with the gas communication port, wherein a part of the jet nozzle is located in the gas outlet, a gap is provided between the jet nozzle and an inner wall of the gas outlet, and the gas outlet and the jet port form the jet flow outlet.

12. The plasma-electrolytic polishing system according to claim 11, wherein a part of the jet-out area block is located in the gas outlet, a position of the jet-out area block with a maximum cross section width is located at a tail end of the jet-out area block, and the tail end of the jet-out area block is not located in the gas outlet.

13. The plasma-electrolytic polishing system according to claim 12, wherein the cross section width of the jet-out area block is gradually increased towards the tail end of the jet-out area block.

14. The plasma-electrolytic polishing system according to claim 11, wherein the jet nozzle is provided with a flowing passage, a tail end of the flowing passage is the jet port, and a position of the flowing passage with a minimum cross section width is located at the tail end of the flowing passage.

15. The plasma-electrolytic polishing system according to claim 11, wherein the gas outlet has a calibre, and the calibre is gradually increased towards a tail end of the gas outlet.

16. The plasma-electrolytic polishing system according to claim 11, wherein the jet module further comprises:

a connecting member, connected to the post and the sleeve member, wherein the connecting member is an insulator.

17. The plasma-electrolytic polishing system according to claim 9, wherein a surface of the fixing seat facing the jet module is provided with at least one flow guide passage.

* * * * *